US012447519B2

(12) United States Patent
Allor et al.

(10) Patent No.: US 12,447,519 B2
(45) Date of Patent: Oct. 21, 2025

(54) DEVICE AND METHOD FOR LEVELING A METAL PLATE

(71) Applicant: Allor Manufacturing, Inc., Brighton, MI (US)

(72) Inventors: Anthony Allor, Fenton, MI (US); James Kitson, Davisburg, MI (US)

(73) Assignee: Allor Manufacturing, LLC, Brighton, MI (US)

( * ) Notice: Subject to any disclaimer, the term of this patent is extended or adjusted under 35 U.S.C. 154(b) by 838 days.

(21) Appl. No.: 17/644,965

(22) Filed: Dec. 17, 2021

(65) Prior Publication Data

US 2022/0193744 A1 Jun. 23, 2022

Related U.S. Application Data

(60) Provisional application No. 63/126,872, filed on Dec. 17, 2020.

(51) Int. Cl.
*B21D 1/02* (2006.01)

(52) U.S. Cl.
CPC ..... *B21D 1/02* (2013.01)

(58) Field of Classification Search
CPC ... B21D 1/02; B21D 3/02; B21D 3/04; B21D 3/05; B21B 1/22; B21B 2015/0071
USPC ..... 72/165, 160
See application file for complete search history.

(56) References Cited

U.S. PATENT DOCUMENTS

| | | | | |
|---|---|---|---|---|
| 4,866,967 | A * | 9/1989 | Sporenberg | B21D 1/05 72/203 |
| 8,333,093 | B2 * | 12/2012 | Kleckner | B21D 7/08 72/203 |
| 9,815,099 | B2 * | 11/2017 | Cox, III | B21B 37/16 |
| 10,010,918 | B2 * | 7/2018 | Kitson | B21D 1/02 |
| 2005/0056067 | A1 * | 3/2005 | Clark | B21B 1/24 72/160 |

* cited by examiner

*Primary Examiner* — Christopher L Templeton
*Assistant Examiner* — Teresa A Guthrie
(74) *Attorney, Agent, or Firm* — Varnum LLP

(57) ABSTRACT

A device to level a metal plate fabricated from a material includes a frame, a leveling station, and a draw device. The leveling station includes a single upper roller and a pair of lower rollers in parallel arrangement and defining a serpentine path. A plunge depth is defined based upon a difference between a top-dead-center point of the lower rollers and a bottom-dead-center point of the single upper roller. A longitudinal spacing and the plunge depth are configured such that the single upper roller and the lower rollers are disposed to impart a bend radius on the metal plate as the metal plate is drawn or moved through the serpentine path such that the metal plate has line contact with the outer peripheral surfaces of the single upper roller and the lower rollers. The bend radius is selected to achieve plastification of the metal sheet.

3 Claims, 4 Drawing Sheets

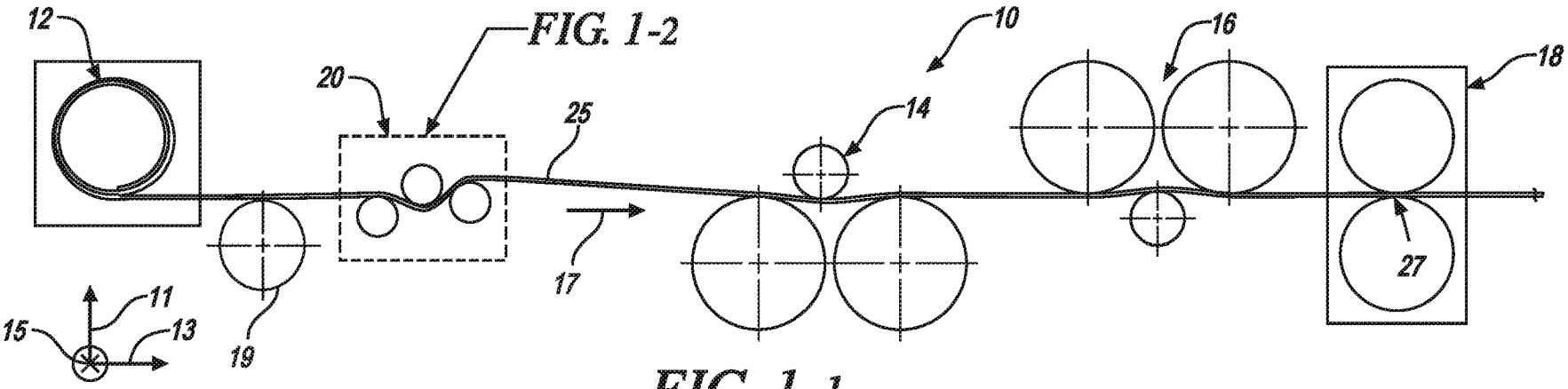
FIG. 1-2
FIG. 1-1
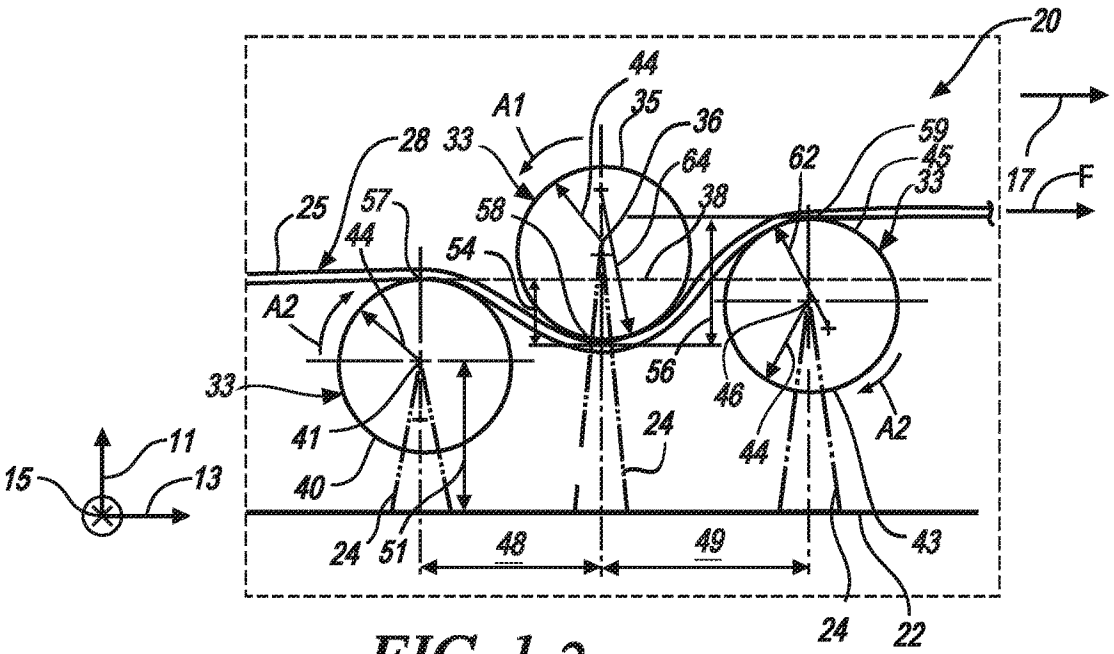
FIG. 1-2

DEVICE AND METHOD FOR LEVELING A METAL PLATE

CLAIM OF PRIORITY AND CROSS-REFERENCE TO RELATED APPLICATIONS

This application claims the benefit of priority from U.S. Provisional Patent Application No. 63/126,872, filed on Dec. 17, 2020, which is incorporated by reference in its entirety.

TECHNICAL FIELD

The present disclosure is related to a device and method of leveling a metal plate.

BACKGROUND

A metal plate may be subject to leveling to achieve a desired flatness that facilitates further processing of the metal plate. Metal plates fabricated from high-strength metals introduce added complexity to leveling due to increased elasticity and yield strengths.

SUMMARY

One aspect of the disclosure provides a method for leveling a metal material having opposing surfaces. The method includes providing a serpentine path in a longitudinal direction between a single upper roller and a corresponding single pair of lower rollers that are rotatably disposed in a parallel arrangement in a lateral direction to accommodate the metal material therebetween, such that the longitudinal direction is associated with a direction of travel for the metal material; where single upper roller includes an upper roller radius and an outer peripheral surface that define a bottom-dead-center point and each of the single pair of lower rollers includes a lower roller radius and an outer peripheral surface that define a top-dead-center point. The single pair of lower rollers includes a first lower roller and a second lower roller.

Providing the serpentine path includes positioning the single upper roller and the pair of lower rollers. More specifically, the single upper roller is positioned in between the first lower roller and the second lower roller in the longitudinal direction such that a first longitudinal spacing is defined between the axis of rotation of the first lower roller and the single upper roller and a second longitudinal spacing is defined between the axis of rotation of the single upper roller and the second lower roller. The first lower roller is positioned relative to the single upper roller in an elevation direction, such that a first plunge depth is defined as a difference in the elevation direction between a first lower elevation associated with the top-dead-center point of the first lower roller and an upper elevation associated with the bottom-dead-center point of the single upper roller. The second lower roller is positioned relative to the single upper roller in the elevation direction, such that a second plunge depth is defined as a difference in the elevation direction between a second elevation associated with the top-dead-center point of the second lower roller and the upper elevation associated with the bottom-dead-center of the single upper roller.

The magnitude of the first plunge depth is less than the magnitude of the second plunge depth, such that the first lower roller and the single upper roller impart a first bend radius on the metal material in a first orientation and the single upper roller and the second lower roller impart a second bend radius on the metal material in a second orientation that is opposite the first orientation when the metal material moves through the serpentine path. As such, plastification is imparted to the metal material that is sufficiently level on both surfaces thereof. A magnitude of plastification of the metal material is sufficient to level the metal material. The magnitude of the first bend radius is less than the magnitude of the second bend radius. Further, there is a quantity of not more than the single upper roller and a quantity of not more than the single pair of lower rollers to achieve the sufficient plastification on both sides of the metal material.

Each surface of the metal material bends about the portion of the outer peripheral surfaces of the respective one of the single pair of lower rollers and the respective single upper roller to achieve a magnitude of plastification of the metal material on an opposite side corresponding to the opposite surface that is greater than 90%. The serpentine path further includes positioning the first lower roller in an elevation direction at a first elevation, such that a top-dead-center point is at a passline; positioning the second lower roller in an elevation direction at a second elevation, such that a top-dead-center point is above the passline; and positioning the single upper roller in an elevation direction such that a bottom-dead-center point is below the passline.

A required bend radius may be determined as a function of a modulus of elasticity of the metal material, a thickness of the metal material, the magnitude of plastification of the metal material, and a yield strength of the metal material; and selecting a plunge depth configured to achieve the required bend radius.

Another aspect of the disclosure provides a device configured to level a metal material fabricated from a metal material. The device includes a frame and a leveling station. The leveling station includes a single upper roller and a corresponding single pair of lower rollers, rotatably disposed on the frame in a parallel arrangement in a lateral direction to define a serpentine path that is disposed in a longitudinal direction associated with a direction of travel for the metal material. The single upper roller includes a cylindrical outer peripheral surface that extends in the lateral direction and radially surrounds an upper axis of rotation, where each one of the single pair of lower rollers includes a cylindrical outer peripheral surface that extends in the lateral direction and radially surrounds a lower axis of rotation, where the single pair of lower rollers includes a first lower roller and a second lower roller. The upper axis of rotation of the single upper roller is positioned in between the lower axes of rotation of the first lower roller and the second lower roller in the longitudinal direction, such that a first longitudinal spacing is defined between the lower axis of rotation of the first lower roller and the upper axis of rotation of the single upper roller and a second longitudinal spacing is defined between the upper axis of rotation of the single upper roller and the lower axis of rotation of the second lower roller. The first lower roller is positioned in an elevation direction at a first elevation, such that a top-dead-center point is at a passline, and the second lower roller is positioned in an elevation direction at a second elevation, such that a top-dead-center point is above the passline.

A first plunge depth is defined as a difference in the elevation direction between the first elevation associated with the top-dead-center point of the first lower roller and an upper elevation that is associated with a bottom-dead-center point of the single lower roller. A second plunge depth is defined as a difference in the elevation direction between the upper elevation that is associated with the bottom-dead-center point of the single upper roller and the second elevation associated with the top-dead-center point of the second lower roller; where the serpentine path is defined between the outer peripheral surfaces of adjacent ones of the single pair of lower rollers and the single upper roller.

The magnitude of the second longitudinal spacing is greater than the magnitude of the first longitudinal spacing, where the plunge depths are configured such that the first lower roller and the single upper roller impart a first bend radius on the metal material in a first orientation and the single upper roller and the second lower roller subsequently impart a second bend radius on the metal material in a second orientation that is opposed to the first orientation as the metal material moves through the serpentine path. The metal material bends about a portion of the outer peripheral surfaces of each one of the pair of lower rollers and the single upper roller to subject the metal material to plastic deformation. The plastic deformation is on the opposite side of the material being bent around the respective outer peripheral surfaces. The magnitude of the first bend radius and the magnitude of the second bend radius is selected such that plastification of the metal material that is sufficiently level on both sides is achieved.

BRIEF DESCRIPTION OF THE DRAWINGS

FIGS. 1-1 and 1-2 are schematic illustrations of a leveler that is capable of leveling a metal sheet, including a coil feeder device, a leveling station, an anti-crossbow station, an anti-coilset station and a draw device that are shown in context of an elevation direction, a lateral direction, and a longitudinal direction, in accordance with the disclosure;

FIG. 2 is a graphical illustration of a stress/strain relationship for metals, depicting modulus of elasticity, elastic deformation, yield strength and plastic deformation for select metal alloys, in accordance with the disclosure;

DETAILED DESCRIPTION

The components of the disclosed embodiments, as described and illustrated herein, may be arranged, and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some, or all, of these details. Moreover, for the purpose of clarity, certain technical material that is known in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, down, upper, lower, upward, and downward may be used with respect to the drawings. These and similar directional terms are not to be construed to limit the scope of the disclosure in any manner. Furthermore, the disclosure, as illustrated and described herein, may be practiced in the absence of any element that is not specifically disclosed herein.

Figure 2:
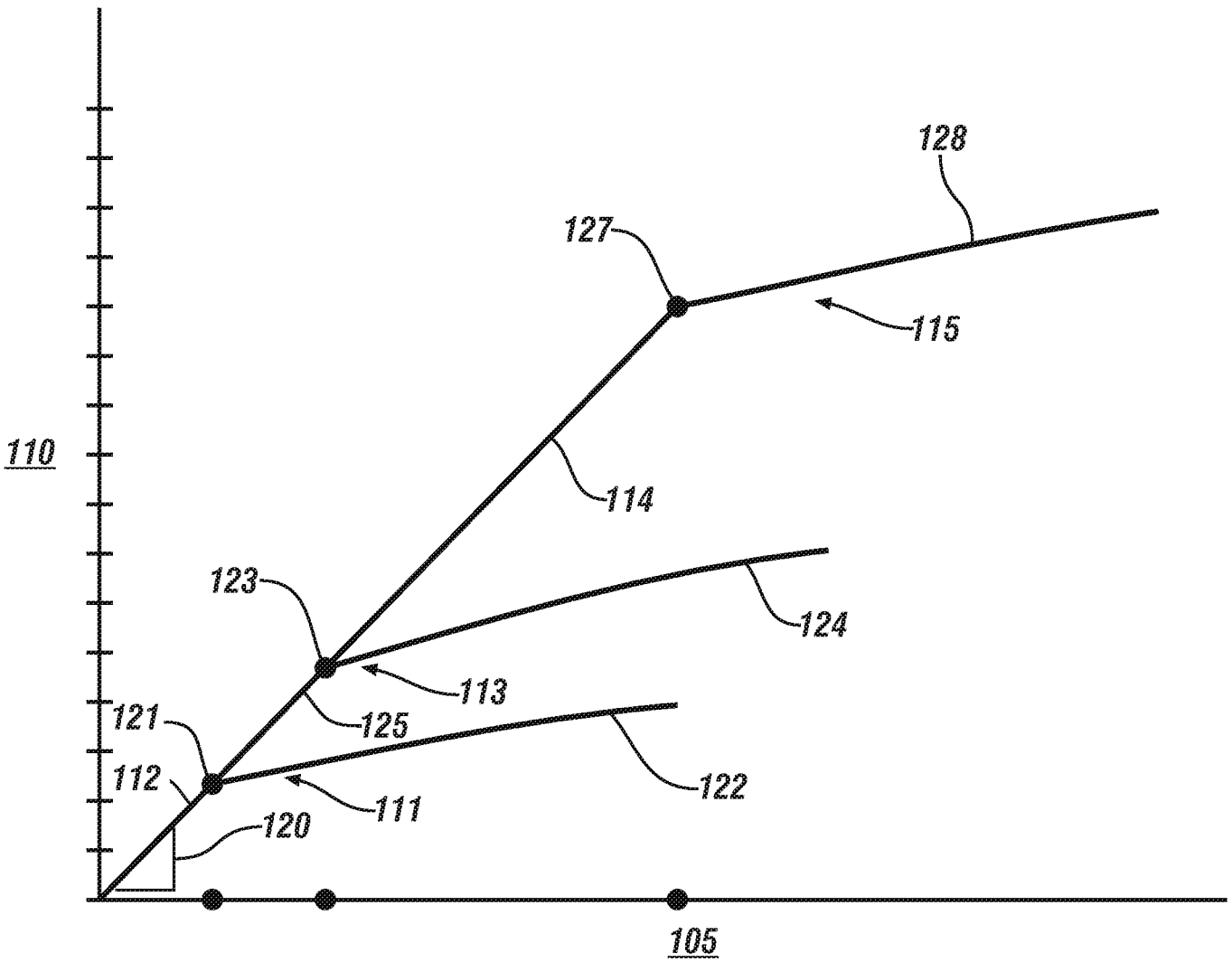

Referring to the drawings, wherein like reference numbers refer to like components throughout the several Figures, a side-view of a leveler 10 that is capable of leveling a metal sheet 25 that has been fabricated from metal materials is shown schematically in FIGS. 1-1 and 1-2. The metal sheet 25 may be in the form of a metal strip, coil material, or a plate. Leveling is the process by which a leveling machine, i.e., the leveler 10, flattens the metal sheet 25 to comply with a flatness specification. The metal strip may be in the form of coiled material. The terms "plate" and "sheet" are used interchangeably throughout this disclosure. The leveler 10 preferably includes a coil feeder device 12, a passline roll 19, a leveling station 20, an anti-crossbow station 14, and an anti-coilset station 16, all of which are shown in context of a coordinate system that includes an elevation direction 11, a longitudinal direction 13 and a lateral direction 15. A direction of travel 17 associated with movement of the metal sheet 25 through the leveler 10 is indicated, and the coil feeder device 12 may be any suitable device capable of uncoiling the metal sheet 25 when it is supplied in coiled form. The coil feeder device 12 is preferably configured so that it provides a slight holdback tension on the metal sheet 25 that is related to uncoiling the metal sheet 25. The passline roll 19 is positioned upstream of the leveling station 20, opposite the direction of travel 17, and sets a height of a passline 38, in the elevation direction 11, of the metal sheet 25 prior to entry into the leveler 10. The passline 38 is an arbitrary line, i.e., a reference line. The leveler 10 may include a draw device 18 that is any suitable device that is capable of exerting a pull force F on a leading end 27 of the metal sheet 25 (i.e., downstream from the leveling station 20 in the direction of travel 17) and shown as a unitary device for ease of illustration. The draw device 18 is illustrated as pinch rolls in FIG. 1-1, but may be any other device suitable for moving the sheet 25, including, but not limited to, a recoiler, a gripping mechanism, a track drive, and the like. The draw device 18 is configured to pull or otherwise draw the metal sheet 25 through the leveling station 20, in the direction of travel 17. Additionally, the rollers 35, 40, 45 may be configured as driven rolls to move the metal sheet 25, while the draw device 18 creates the required tension near the exit of the sheet from the leveler 10. The anti-crossbow station 14 and the anti-coilset station 16 may be any suitable devices capable of accomplishing their respective tasks.

The leveling station 20 of the leveler 10 is advantageously configured to level a metal plate, such as a metal plate that is fabricated from high-strength steel, e.g., the metal sheet 25 described herein, by bending the metal sheet 25 up and down as it is drawn along a serpentine path 28 over interrupting arcs of a single upper roller 35 and a pair of lower rollers 40, 45. It should be appreciated, however, that the metal sheet 25 does not have to be fabricated from high-strength material. The process of successively alternating the bends of the metal sheet 25 stretches both sides of the metal sheet 25 beyond elastic limits to effect leveling, and no back tensioning of the metal sheet 25 is required throughout the leveling process. The leveling station 20 preferably includes a frame 24 that is preferably disposed on a foundation 22 to support the single upper roller 35 and the pair of lower rollers 40, 45, as shown. The single upper roller 35 and the pair of lower rollers 40, 45 are rotatably disposed on the frame 24 in parallel arrangement in the lateral direction 15 using suitable bearings, axles, and related hardware. In one embodiment, the upper roller 35 and the pair of lower rollers 40, 45 are rotatably disposed on the frame 24 in a freewheeling manner. As such, the rollers 35, 40, 45 rotate about a respective axis in response to the draw device 18 exerting the pull force F on the leading end 27 of the metal sheet 25. In another embodiment, in an absence of or in addition to the draw device 18, the upper roller 35 and the pair of lower rollers 40, 45 are rotatably disposed on the frame 24 and include drive motors configured to exert a suitable rotational force to turn the rollers 35, 40, 45 about the respective axis of rotation in order to move the metal sheet 25 around the respective rollers 35, 40, 45 and along the serpentine path 28. As shown in FIG. 1-2, the single upper roller 35 rotates in a first direction A1 and the pair of second rollers 40, 45 rotate in a second direction A2, opposite the first direction A1. As such, the upper roller 35 and the pair of lower rollers 40, 45 cooperate to define the serpentine path 28, which is oriented in the longitudinal direction 13, and is configured to accommodate the metal sheet 25.

The single upper roller 35 extends in the lateral direction 15. The upper roller 35 defines an upper axis of rotation 36 and includes a cylindrical outer peripheral surface 33 surrounding the upper axis of rotation 36 that defines an upper roller radius 44. Each of the pair of lower rollers 40, 45 (i.e., a first lower roller 40 and a second lower roller 45, respectively) also extends in the lateral direction 15 in parallel with the single upper roller 35. As indicated, the first lower roller 40 defines a first lower axis of rotation 41 and the second lower roller 45 defines a second lower axis of rotation 46. The first and second lower rollers 40, 45 each includes a cylindrical outer peripheral surface 33 surrounding the respective axis of rotation 41, 46 that define a lower roller radius 44.

The lower rollers 40, 45 are disposed such that their axes of rotation 41, 46 are at different heights in the elevation direction 11.

The axis of rotation 36 of the upper roller 35, is preferably offset in the longitudinal direction 13 from the axes of rotation 41, 46 of the lower rollers 40, 45, such that longitudinal spacings 48, 49 are defined between the axes of rotation 41, 36, 46 of the contiguous ones of the upper and lower rollers 35, 40, 45. As shown, this includes a first longitudinal spacing 48 between the axis of rotation 41 and the axis of rotation 36, and a second longitudinal spacing 49 between the axis of rotation 36 and the axis of rotation 46. In one embodiment, the first and second longitudinal spacings 48, 49 are not equal in length. More specifically, as schematically illustrated in FIG. 1-2, the first longitudinal spacing 48 is less than the second longitudinal spacing 49. In another embodiment, the first and second longitudinal spacings 48, 49 are equal in length.

With continuing reference to FIG. 1-2, a passline 38 is preferably even with the top-dead-center point 57 of the first lower roller 40, in the elevation direction 11. A first plunge depth 54 is related to a difference between top-dead-center point 57 of the first lower roller 40 and the bottom-dead-center point 58 of the single upper roller 35, in the elevation direction 11. A second plunge depth 56 is related to a difference between bottom-dead-center point 58 of the upper roller 35 and the top-dead-center point 59 of the second lower roller 45, in the elevation direction 11. The top-dead-center point 57 is the uppermost point on the first lower roller 40, and the bottom-dead-center point 58 is the lowermost point on the single upper roller 35, and the top-dead-center point 59 is the uppermost point on the second lower roller 45, all in the elevation direction 11. In one embodiment, the first plunge depth 54 is less than the second plunge depth 56. The first and second plunge depths 54, 56 are determined based on a difference between the bottom-dead-center point 58 of the single upper roller 35 and each of the top-dead-center points 57, 59 of the respective lower rollers 40, 45, in the elevation direction 11. The serpentine path 28 is defined between the outer peripheral surfaces 33 of contiguous ones of the single upper roller 35 and lower rollers 40, 45.

The leveling station 20 is configured such that the longitudinal spacings 48 and 49, the plunge depths 54 and 56, the upper roller radius 44 and the lower roller radii 44 impart a desired bend radius 64, 62 on the metal plate 25 as the metal plate 25 is drawn through the serpentine path 28 such that the metal plate 25 has line contact with the outer peripheral surfaces 33 of the single upper roller 35, at the bottom-dead-center point 58 between the first and second lower rollers 40, 45, to achieve the first bend radius 64. Next, as the metal plate 25 travels through the serpentine path 28, an opposing side of the metal plate 25 has line contact with the outer peripheral surface 33 of the second lower roller 45, at the top-dead-center point 59, to achieve the second bend radius 62. As the metal plate 25 has line contact with the outer peripheral surfaces 33, the metal plate 25 is subjected to plastic deformation by bending.

When a relatively small force is applied to a material it deforms a little, the deformation of the metal may be elastic, and may be linearly proportional to the applied force. The ratio of stress to strain is called modulus of elasticity, or Young's modulus. For steel, the modulus of elasticity is approximately one divided by 30 million psi (1/30E6 psi). For aluminum, the modulus of elasticity it is about one divided by ten million psi (1/10E6 psi). The modulus of elasticity applies when the material is stressed low enough to return to its original shape when the force is released. If the metal is never stressed beyond its elastic range, the metal will never permanently change shape. However, stressing metal beyond its elastic range causes it to become plastic, i.e., to permanently deform. This occurs when the applied stress reaches or exceeds a yield strength of the material.

The leveler 10 employs bending to subject the metal sheet 25 to bending stress that is greater than its yield strength, thus plastifying at least a portion of the metal sheet 25 to affect its leveling. The bending is achieved by drawing the metal sheet 25 through the serpentine path 28 to subject the metal sheet 25 to bending stress that is greater than its yield strength.

By way of a non-limiting example, in order to achieve a bend radius of 1.474 inches for a steel plate 25 that is 0.130 inches thick with a 100,000 psi yield strength, one embodiment of the leveling station 20 may be configured with the single upper roller 35 and the pair of lower rollers 40, 45 each having a diameter of 2.000 inches, on 4.500 inch centers. The rollers 35, 40, 45 are arranged at a first longitudinal spacing 48 of 2.018 inches and a second longitudinal spacing 49 of 2.414 inches. The top-dead-center points 57, 59 of the first and second lower rollers 40, 45 are offset from one another by 0.781" in the elevation direction 11. A plunge 54 between the first lower roller 40 and the single upper roller 35 may be −0.485 inches, resulting in plastification on one side of the steel plate 25. The top-dead-center point 57 of the first lower roller 40 is at the passline 38, the bottom-dead-center point 58 of the single upper roller 35 is below passline 38, and the second lower roller 45 is positioned in the elevation direction 11 such that its top-dead-center point 59 is above the passline 38. This arrangement of the rollers 35, 40, 45 forces a tight bend around the second lower roller 45, to generate plastification on the other side of the steel sheet 25, while using only the single upper roller 35 and the two lower rollers 40, 45 described herein. More specifically, the required draw force to achieve greater than 85% plastification may be less than 55,000 pounds. The arrangement may be further defined as being capable of generating plastification of the steel sheet that is between 95% and 100%. Thinner gauge metal sheets require a smaller or tighter bend radius, which leads to smaller roller radii. This concept applies to steel and other metal alloys of any magnitude of yield strength.

It should be appreciated that the plastification may be different amounts than listed herein, as the plastification needs to be sufficient to level the material. In one embodiment, plastification that is sufficient to level the material may be determined based on I-units, where I-units are a measure of the flatness of the strip or plate produced. I-units may be determined based on the following formula: I-units=(h/l)2× 24.649, where "h" is the peak-to-peak amplitude, and "l" is the distance between peaks (i.e., wavelength) of the shape defects in the strip. Sometimes, by convention in operation, 24.649 is rounded to 25 in use of this equation in determining the I-units. Other methods of determining plastification that is sufficient to level the material may also be used, as known to those of skill in the art.

FIG. 2 graphically illustrates a stress/strain relationship for various metals, with the horizontal axis 105 indicating strain or elongation percent, and the vertical axis 110 indicating stress on the metals. Results associated with three metals are shown, including a modulus of elasticity and a yield strength for a first metal 111, a second metal 113 and a third metal 115. The first metal 111, known in the industry as A-36, is characterized in terms of a modulus of elasticity 120 of about 1/30E6 psi, an elastic deformation portion 112, a yield strength 121 of about 36,000 psi, and a plastic deformation portion 122. The second metal 113, known in the industry as X70, is characterized in terms of a modulus of elasticity 120 of about 1/30E6 psi, an elastic deformation portion 125, a yield strength 123 of about 70,000 psi, and a plastic deformation portion 124. The third metal 115, known in the industry as AR500, is characterized in terms of a modulus of elasticity 120 of about 1/30E6 psi, an elastic deformation portion 114, a yield strength 127 of about 180,000 psi, and a plastic deformation portion 128. The third metal 115 has an elastic limit or yield strength that is five times greater than that of the first metal 111. The second metal 113 and the third metal 115 are high-strength steel materials, wherein the term "high-strength" is assigned based upon the associated yield strength.

A bend radius can be defined for a metal sheet, in relation to various factors, as follows:

$$Rs=E*T/k*Ys \quad [1]$$

wherein:

Rs is the bend radius (inches),

E is the modulus of elasticity (psi),

T is the thickness of the metal sheet (inches), k is a scalar term associated with the desired magnitude of plastification of the metal sheet, and Ys is the yield strength of the metal (psi).

The term "plastification" and related terms refer to plastically elongating an element, e.g., a metal sheet, including subjecting the metal sheet to stress that is in excess of its elastic limit, and may be defined in terms of a portion (%) of a cross-sectional area of the metal sheet. As such, a metal sheet that has only been subjected to stress that is less than its elastic limit has a 0% plastification, and a metal sheet that has been completely subjected to stress that is greater than its elastic limit has a 100% plastification.

Referring again to FIG. 2, the third metal 115 exhibits a yield strength 127 of about 180,000 psi, which is a factor of five greater than the yield strength 121 of the first metal 111. As such, the third metal 115 requires a bend radius that is five times smaller than the bend radius of the first metal 111 to achieve the same magnitude of plastification.

As the yield strength increases the bend radius, the required draw force F increases at a linear rate. In this case it is a 5:1 ratio for A36 and 180,000 yield materials. However, the plunge depth 55 required to achieve the desired magnitude of plastification is non-linear. The material thickness may be 0.040 to 0.250 inches. Thinner gauge steel requires a greater increase in plunge depth as the yield strengths increase as compared to thicker gauges. This requires the roll diameter to get smaller as the yield strengths increase for thin gauge steel. Therefore, the size of the roll diameter is a function of the material thickness.

Figure 3:
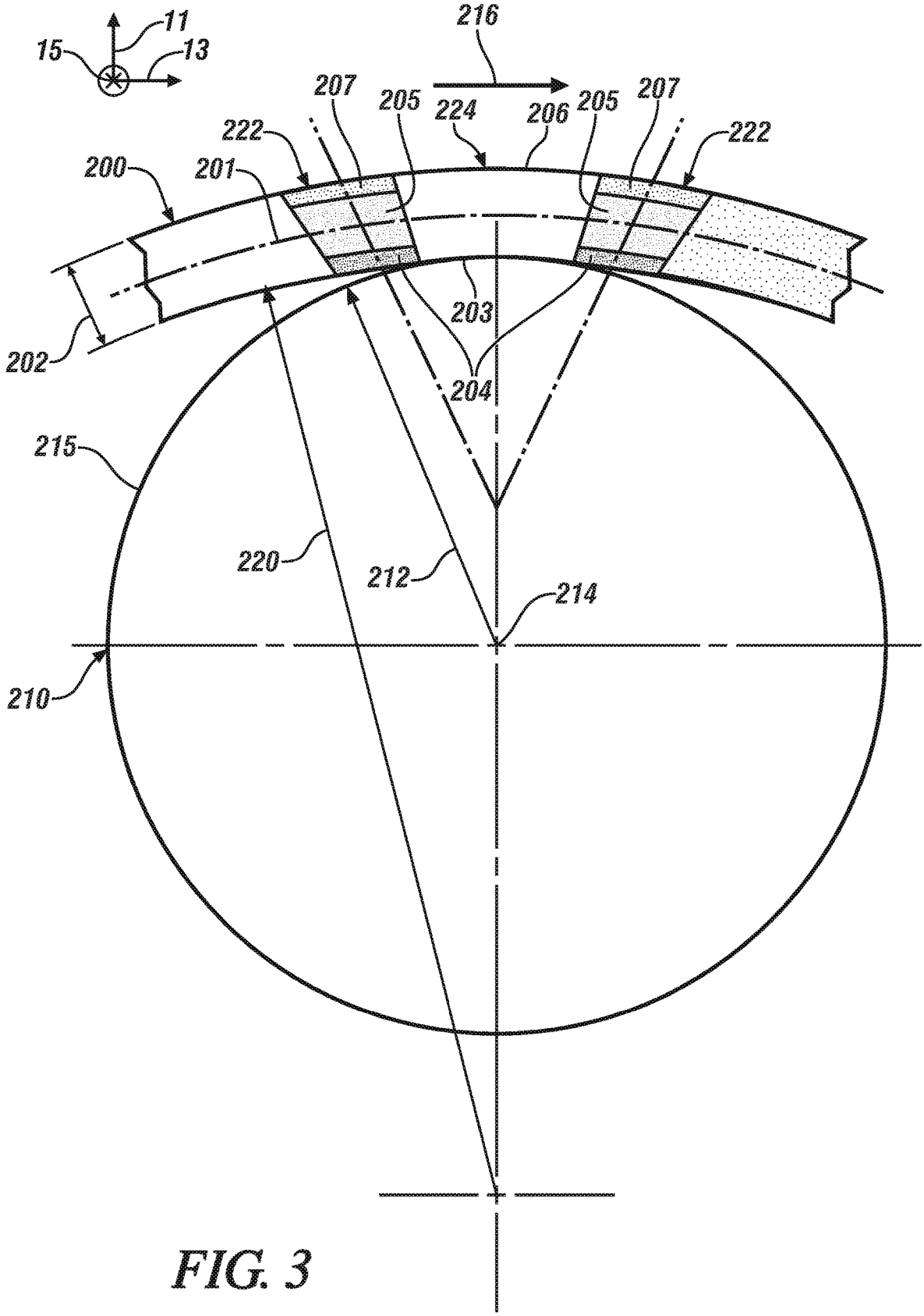
FIG. 3 schematically shows a side-view of a portion of a metal sheet that is being drawn across a roller in the longitudinal direction at a first bending radius such that the metal sheet has line contact with the roller, in accordance with the disclosure.

FIG. 3 schematically shows a side-view of a portion of a high-strength metal sheet 200 that is being drawn across a roller 210 in the longitudinal direction 13, such that the metal sheet 200 has line contact with the roller 210 at a first bending radius 220, with the metal sheet 200 and roller 210 extending in the lateral direction 15. The metal sheet 200 is characterized in terms of a thickness 202, and is described in terms of a centerline 201, an inner surface 203 and an outer surface 206, wherein the inner surface 203 is that portion of the metal sheet 200 that is proximal to the roller 210 and the outer surface 206 is that portion of the metal sheet 200 that is distal from the roller 210. The roller 210 is analogous to the single upper roller 35 and the pair of lower rollers 40, 45 that is described with reference to FIG. 1, and includes an axis of rotation 214 and a cylindrical outer peripheral surface 215 surrounding the axis of rotation 214 that define a roller radius 212. A direction of travel 216 is shown and indicates the direction that the metal sheet 200 is being drawn.

The metal sheet 200 includes areas of stress deformation 222 and an area of conformance 224 as the metal sheet 200 is drawn across the roller 210 and is subject to bending in conformance with the roller 210. The areas of stress deformation 222 include an inner portion 204 that is adjacent to the inner surface 203 and an outer portion 207 that is adjacent to the outer surface 206. The first bending radius 220 is determined in accordance with EQ. 1.

When the metal sheet 200 is subjected to forces that achieve the first bending radius 220, the areas of stress deformation 222 may be defined in terms of an inner portion 204, a neutral portion 205 and an outer portion 207. The outer portion 207 delineates that portion of the cross-sectional area of the metal sheet 200 that is subject to bending that is sufficient to be plastically elongated. The inner portion 204 delineates that portion of the cross-sectional area of the metal sheet 200 that is subject to bending that is sufficient to be plastically compressed, and also be plastically elongated when bent in an opposed direction. The neutral portion 205 is only subjected to elastic bending. The inner portion 204 and the outer portion 207 define the magnitude of plastification of the metal sheet 200, which may be in the order of magnitude of 50% as shown.

Figure 4:
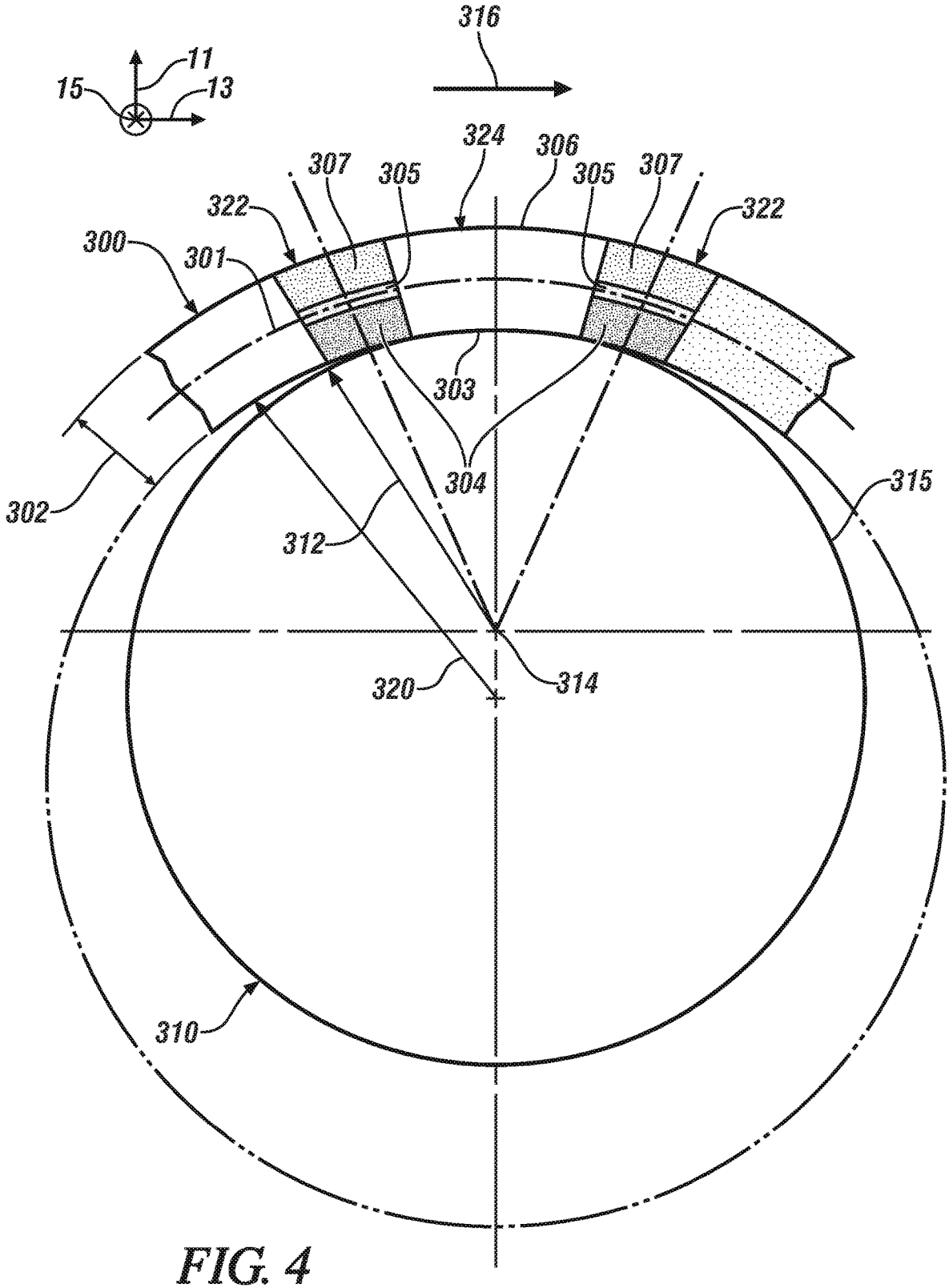
FIG. 4 schematically shows a side-view of a portion of a metal sheet that is being drawn across a roller in the longitudinal direction at a second bending radius such that the metal sheet has line contact with the roller, in accordance with the disclosure.

FIG. 4 schematically shows a side-view of a portion of a high-strength metal sheet 300 that is being drawn across a roller 310 in the longitudinal direction 13 at a second bending radius 320 such that the metal sheet 300 has line contact with the roller 310, with the metal sheet 300 and roller 310 extending in the lateral direction 15. The metal sheet 300 is characterized in terms of a thickness 302, and is described in terms of a centerline 301, an inner surface 303 and an outer surface 306, wherein the inner surface 303 is that portion of the metal sheet 300 that is proximal to the roller 310 and the outer surface 306 is that portion of the metal sheet 300 that is distal from the roller 310. The roller 310 is analogous to one of the upper or lower rollers 35, 40, 45 that are described with reference to FIG. 1, and includes an axis of rotation 314 and a cylindrical outer peripheral surface 315 surrounding the axis of rotation 314 that define a roller radius 312. A direction of travel 316 is shown and indicates the direction that the metal sheet 300 is being drawn.

The metal sheet 300 includes areas of stress deformation 322 and an area of conformance 324 as the metal sheet 300 is drawn across the roller 310 and is subject to bending in conformance with the roller 310. The areas of stress deformation 322 include an inner portion 304 that is adjacent to the inner surface 303 and an outer portion 307 that is adjacent to the outer surface 306. The second bending radius 320 is determined in accordance with EQ. 1.

When the metal sheet 300 is subjected to forces that achieve the first bending radius 320, the areas of stress deformation 322 may be defined in terms of an inner portion 304, a neutral portion 305 and an outer portion 307. The outer portion 307 delineates that portion of the cross-sectional area of the metal sheet 300 that is subject to bending that is sufficient to be plastically elongated. The inner portion 304 delineates that portion of the cross-sectional area of the metal sheet 300 that is subject to bending that is sufficient to be plastically compressed, and also be plastically elongated when bent in an opposed direction. The neutral portion 305 is only subjected to elastic bending. The inner portion 304 and the outer portion 307 define the magnitude of plastification of the metal sheet 300, which may be in the order of magnitude of 90% for the bending radius 320.

As such, bending (i.e., the bending radius 320) is achieved by controlling the plunge depths 54, 56 via, in part, the longitudinal spacings 48, 49 between the axes of rotation 41, 36, 46 of the contiguous ones of the upper and lower rollers 40, 35, 45, and increasing the elevation 11 of the axis of rotation 46 of the second lower roller 45, relative to the elevation 11 of the first lower roller 40 and the passline 38. Decreasing the bending radius from the first bending radius 220 shown with reference to FIG. 3 to the second bending radius 320 shown with reference to FIG. 4 results in an increase in the plastification of the associated metal sheet.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A method for leveling a metal material having opposing surfaces, comprising:

providing a serpentine path in a longitudinal direction between a single upper roller and a corresponding single pair of lower rollers that are rotatably disposed in a parallel arrangement in a lateral direction, such that the longitudinal direction is associated with a direction of travel for the metal material;

wherein the single upper roller includes an upper roller radius and an outer peripheral surface that define a bottom-dead-center point that is positioned below a passline, and each of the single pair of lower rollers includes a lower roller radius and an outer peripheral surface that define a top-dead-center point;

wherein the serpentine path and the upper and lower rollers are disposed to accommodate the metal material;

wherein the single pair of lower rollers includes:

a first lower roller positioned such that the top-dead-center point thereof is disposed at the passline; and a second lower roller positioned such that the top-dead-center point thereof is above the passline;

wherein providing the serpentine path includes:

positioning the single upper roller in between the first lower roller and the second lower roller in the longitudinal direction such that a first longitudinal spacing is defined between the axis of rotation of the first lower roller and the single upper roller and a second longitudinal spacing is defined between the axis of rotation of the single upper roller and the second lower roller;

positioning the first lower roller relative to the single upper roller in an elevation direction, such that a first plunge depth is defined as a difference in the elevation direction between a first lower elevation associated with the top-dead-center point of the first lower roller and an upper elevation associated with the bottom-dead-center point of the single upper roller; and positioning the second lower roller relative to the single upper roller in the elevation direction, such that a second plunge depth is defined as a difference in the elevation direction between a second elevation associated with the top-dead-center point of the second lower roller and the upper elevation associated with the bottom-dead-center of the single upper roller;

wherein the magnitude of the first plunge depth is less than the magnitude of the second plunge depth such that the first lower roller and the single upper roller impart a first bend radius on the metal material in a first orientation and the single upper roller and the second lower roller impart a second bend radius on the metal material in a second orientation that is opposite the first orientation when the metal material moves through the serpentine path to provide equal plastification on both sides of the metal material; and wherein a magnitude of plastification of the metal material is sufficient to level the metal material;

wherein the magnitude of the first bend radius is less than the magnitude of the second bend radius; and wherein there is a quantity of not more than the single upper roller and a quantity of not more than the single pair of lower rollers to achieve equal plastification on both sides of the metal material.

2. The method of claim 1, wherein each surface of the metal material bends about the portion of the outer peripheral surfaces of the respective one of the single pair of lower rollers and the respective single upper roller to achieve a magnitude of plastification of the metal material that is greater than 90%.

3. The method of claim 1, further comprising:

determining a required bend radius as a function of a modulus of elasticity of the metal material, a thickness of the metal material, the magnitude of plastification of the metal material, and a yield strength of the metal material; and selecting a plunge depth configured to achieve the required bend radius.

* * * * *